United States Patent [19]

Morais

[11] 4,101,809

[45] Jul. 18, 1978

[54] DISCHARGE LAMP OPERATING CIRCUIT

[75] Inventor: Don Morais, Hendersonville, N.C.

[73] Assignee: General Electric Company, N.Y.

[21] Appl. No.: 800,983

[22] Filed: May 26, 1977

[51] Int. Cl.[2] ..... H05B 37/02; H05B 41/23

[52] U.S. Cl. ..... 315/156; 315/159; 315/207; 315/208; 315/224; 315/283

[58] Field of Search ..... 315/207, 208, 224, 283, 315/287, 156–159, DIG. 7

[56] References Cited

U.S. PATENT DOCUMENTS

| | | | |
|---|---|---|---|
| 3,621,331 | 11/1971 | Barron | 315/207 |
| 3,624,447 | 11/1971 | Nutley et al. | 315/246 |
| 3,917,976 | 11/1975 | Nuckolls | 315/208 X |
| 4,045,709 | 8/1977 | Morais | 315/205 |
| 4,051,411 | 9/1977 | Knoble et al. | 315/205 |

*Primary Examiner*—Alfred E. Smith
*Assistant Examiner*—Charles F. Roberts
*Attorney, Agent, or Firm*—S. Greenberg

[57] ABSTRACT

Pulse operating circuit for high intensity gaseous discharge lamps is provided with improved lamp starting device. The circuit comprises a direct current supply, a transistor switch in series with a ballast inductor and a lamp across the DC supply, an SCR switch connected across the inductor, a control circuit connected to the transistor switch for applying DC pulses to the lamp at a predetermined repetition rate and duty cycle, a sensing circuit for sensing the voltage across the inductor, and a variable SCR firing control circuit connected to the SCR and the first mentioned control circuit and responsive to the sensing circuit to control the firing of the SCR for limiting the peak current through the transistor switch during the lamp starting and warm-up interval. To improve the operation of a starting aid circuit employed with a circuit of the above type, a second control circuit is connected to the first mentioned control circuit to provide for increased "on" time of the transistor switch during the lamp starting interval, after which the transistor switch "on" time is automatically reduced to normal operating level.

13 Claims, 12 Drawing Figures

DISCHARGE LAMP OPERATING CIRCUIT

The present invention relates to discharge lamp operating circuits, and more particularly concerns direct current pulsed operating circuits for such lamps.

It is an object of the invention to provide an improved DC starting and operating circuit for pulsed operation of gaseous discharge lamps.

It is a particular object of the invention to provide a circuit of the above type for use with lamps of high pressure sodium vapor and of mixed metal vapor types of producing improved color properties of the lamp light output.

Another particular object of the invention is to provide a circuit of the above type which the starting and warm-up of the gaseous discharge lamp is facilitated while protecting components of the circuit from damage due to increased lamp current during the starting interval.

Still another object of the invention is to provide a starting circuit for lamp operating circuits of the above type wherein noise due to induction components in the starting circuit is avoided during lamp operation.

Other objects and advantages will become apparent from the following description and the appended claims.

With the above objects in view, the present invention in one of its aspects relates to a lamp starting and operating circuit comprising, in combination, a direct current source, controlled switch means and inductance means connected in series across the power source, means for serially connecting a gaseous discharge lamp to the controlled switch means and the inductance means, means connected to the controlled switch means for limiting the peak current through the controlled switch means during the lamp starting interval, and control means coupled to the controlled switch means for repetitively and sequentially operating the same at predetermined intervals for applying DC pulses to the gaseous discharge lamp for starting and operation thereof.

In a particular embodiment of the invention, the aforesaid means for limiting the peak current through the controlled switch means comprises a sensing circuit for sensing the voltage across the inductance means, second controlled switch means connected across the inductance means, and second control means connected to the sensing circuit, the second controlled switch means and the first mentioned control means for operating the first mentioned controlled switch means in response to the voltage across the inductance means.

In another aspect of the invention, there is provided another control circuit for providing a longer "on" time of the first mentioned controlled switch means during the lamp starting interval than during the normal operation of the lamp, whereby the starting of the lamp is facilitated.

The operating circuit of the invention may be used for applying DC pulses of predetermined duty cycle and repetition rate on the lamp for improving the color and other properties thereof. A method and apparatus for pulsed operation of high pressure sodium vapor lamps for improving the color rendition of such lamps are disclosed in co-pending application Ser. No. 649,900 - Osteen, filed Jan. 16, 1976, now abandoned and assigned to the same assignee as the present invention.

As disclosed in the Osteen application, the high pressure sodium vapor lamp typically has an elongated are tube containing a filling of xenon at a pressure of about 30 torr as a starting gas and a charge of 25 milligrams of amalgam of 25 weight percent sodium and 75 weight percent mercury.

The present invention provides an improved circuit for DC pulsed operation of such lamps in accordance with the method and principles disclosed in the co-pending Osteen application, and the disclosure thereof in the application is accordingly incorporated herein by reference. As there disclosed, pulses may be applied to the lamp having repetition rates above 500 to about 2,000 Hertz and duty cycles from 10% to 30%. By such operation, the color temperature of the lamp is readily increased and substantial improvement in color rendition is achieved without undue loss in efficacy or reduction in lamp life.

The circuit of the present invention is also useful for operating discharge lamps containing mixed metal vapors such as the above described lamp or other lamps in a manner to avoid color separation therein, in accordance with the method and principles disclosed in co-pending application Ser. No. 701,333 — Owen,filed June 30, 1976 and assigned to the same assignee as the present invention. The disclosure thereof in the said Owen application is accordingly also incorporated herein by reference.

The present invention also provides an improvement in the lamp operating circuit disclosed in co-pending application Ser. No. 719,769 of D. W. Knoble and D. Morais, filed Sept. 2, 1976, now U.S. Pat. No. 4,051,411 and assigned to the same assignee as the present invention, and the disclosure thereof is accordingly incorporated herein by reference.

The invention will be better understood from the following description taken in conjunction with the accompanying drawings, in which.

Figure 1:
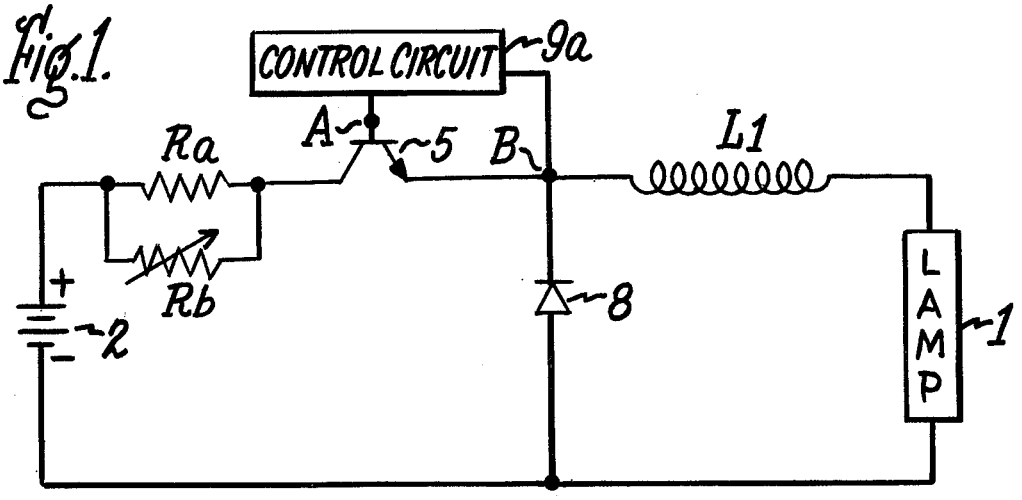
FIG. 1 is a circuit diagram of a lamp starting and operating circuit showing one embodiment of the invention.

Referring now to the drawings, and particularly to FIG. 1, there is shown a circuit diagram illustrating an embodiment of the invention for operating a high intensity gaseous discharge lamp 1 such as the mixed metal vapor type described above. The operating circuit comprises a power supply 2 which may be any suitable source of DC voltage, such as a battery or a rectified AC source such as disclosed in the aforementioned Patent of Knoble and Morais. The pulsing circuit comprises transistor switch 5, induction coil L1 and lamp 1 connected in series across the power supply, and coasting diode 8 connected across the serially connected induction coil L1 and lamp 1. Induction coil L1, lamp 1 and diode 8 thus form a discharge loop, with transistor switch 5 being connected between the DC supply source and this discharge loop. Transistor switch 5 is operated repetitively and sequentially by timing (control) circuit 9*a* connected to the base of transistor 5. Control circuit 9*a* is shown in detail in FIG. 7, as well as in the aforementioned Patent of Knoble and Morais, the disclosure of which is accordingly incorporated herein by reference.

Due to the inherent characteristics of high intensity gaseous discharge lamps, such as represented by lamp 1, the lamp starting current is substantially higher than the normal operating lamp current. This higher starting current must be taken into account when selecting circuit components and wire sizes. Main transistor switch 5 accordingly must be able to sustain the higher lamp starting current. In accordance with a feature of the invention, means are provided for reducing the peak starting current, so that it becomes possible to employ less expensive switches of this type and prolong their operating life.

In the embodiment shown in FIG. 1, such protective means comprise a resistor R*a* in series with transistor switch 5 and a negative temperature coefficient resistor (NTCR) R*b*, which has a certain time constant, in parallel with resistor R*a*. During the lamp starting interval R*b*, being initially cold, has relatively high resistance and the combination of R*a* and R*b* initially serve to limit the peak current through switch 5. As R*b* gradually increases in temperature, due to passage of current therethrough, it exhibits decreasing resistance, and by the end of the lamp starting and warm-up period, when normal lamp operating current passes through switch 5, the resistance of the parallel combination of R*a* and R*b* is at a very low value.

Figure 2:
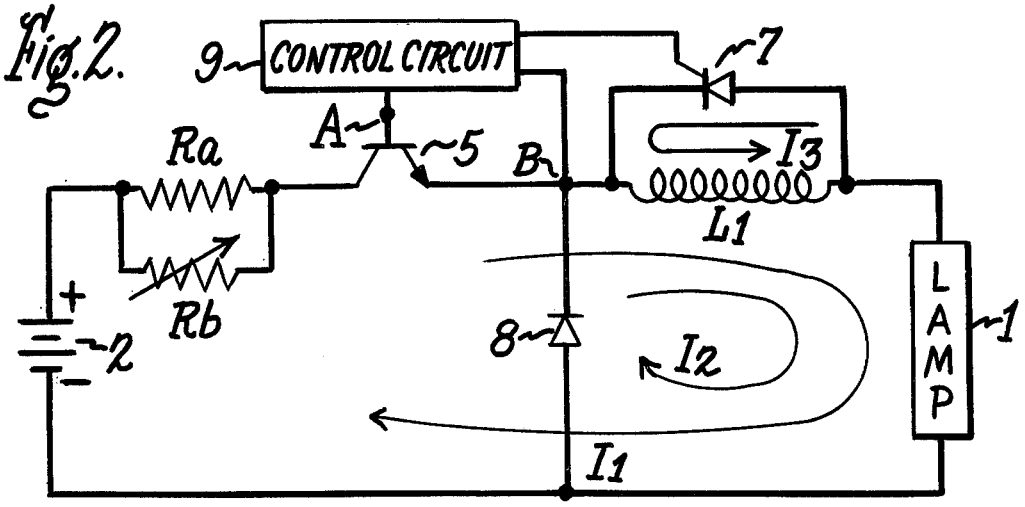
FIG. 2 is a circuit diagram of a modification of the FIG. 1 embodiment.

The embodiment shown in FIG. 2 employs a pulsing circuit similar to that shown in the aforementioned Knoble and Morais Patent, including silicon controlled rectifier (SCR) 7 connected across induction coil L1 with its control (gate) electrode connected to switch control circuit 9.

In the operation of the FIG. 2 circuit, and assuming that lamp 1 is in steady state operation with SCR switch 7 turned on and switch 5 turned off, a current $I_3$ is flowing in the loop comprising SCR 7 and induction coil L1. At this time only a small voltage appears across inductor L1. When transistor switch 5 closes by operation of control circuit 9, a substantially higher voltage appears across inductor L1 and results in commutation (turn-off) of SCR 7 and flow of current $I_1$ through the series circuit of switch 5, inductor L1, and lamp 1 back to the power source. Current $I_1$ then increases with a time constant L/R, where L is the inductance of L1 and R is the effective resistance of lamp 1. This current increases until switch 5 opens, at which time the voltage across inductor L1 reverses polarity, and current $I_2$ begins to flow through the loop comprising inductor L1, lamp 1 and coasting diode 8. This current continues to flow with decreasing value until SCR 7 is triggered on by control circuit 9. Current $I_2$ then ceases, while current $I_3$ is initiated. Current $I_3$ continues to flow until transistor switch 5 closes again, which begins a new cycle.

Further details of the structure and operation of switch control circuit 9 and other components of this circuit are disclosed in the aforementioned Patent of Knoble and Morais and are incorporated herein by reference.

As will be understood, the desired pulse repetition rate and duty cycle to obtain improved color properties of the lamp as disclosed in the aforementioned Osteen and Owen applications are with respect to the lamp current pulses, and control circuit 9 should accordingly be suitably adjusted to operate transistor switch 5 in such a manner as to provide the desired lamp current pulse repetition rate and duty cycle.

Figure 3:
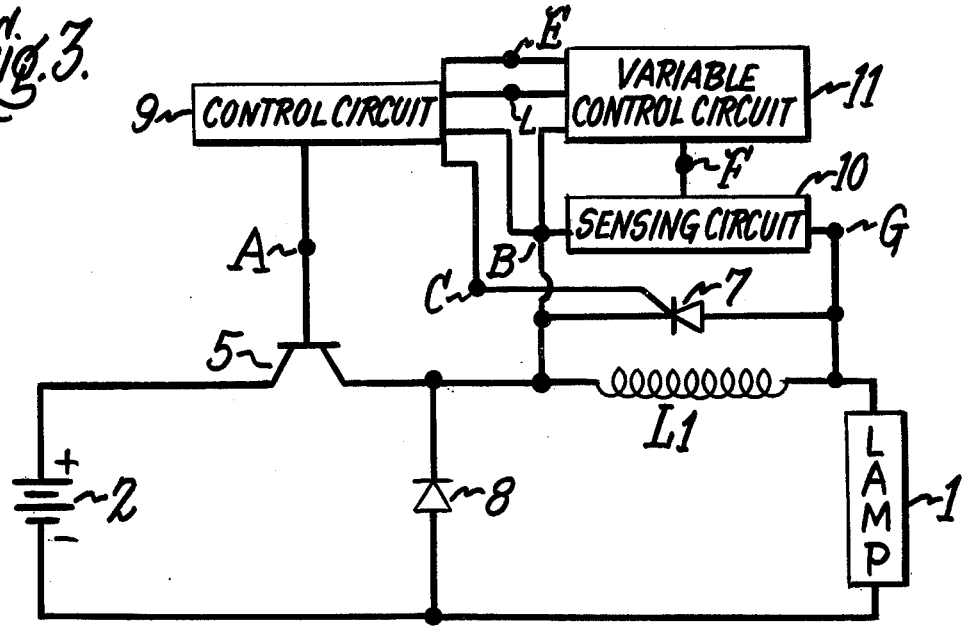
FIG. 3 is a circuit diagram of a different embodiment of the invention.
Figure 9:
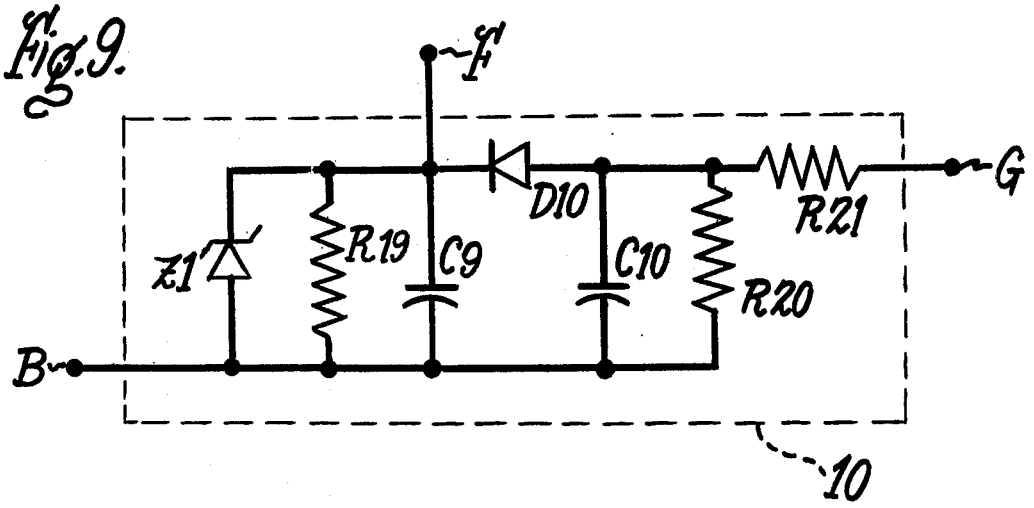
FIG. 9 shows the circuit details of the sensing circuit shown in FIGS. 3, 5 and 6.

In the FIG. 3 embodiment, wherein a lamp pulsing circuit similar to that of FIG. 2 is employed, the means for limiting the peak lamp starting current comprises a sensing circuit 10 connected across inductor L1, and a variable control circuit 11 connected between sensing circuit 10 and switch control circuit 9. Sensing circuit 10, as seen in FIG. 9, comprises a voltage divider formed by resistors R20 and R21 for sensing the voltage developed across induction coil L1, the current being rectified by diode D10 and filtered by capacitor C9. Zener diode Z1 sets the upper limit for this voltage, resistor R19 allows capacitor C9 to discharge when lamp 1 goes off, and capacitor C10 serves as a transient bypass.

Figure 4:
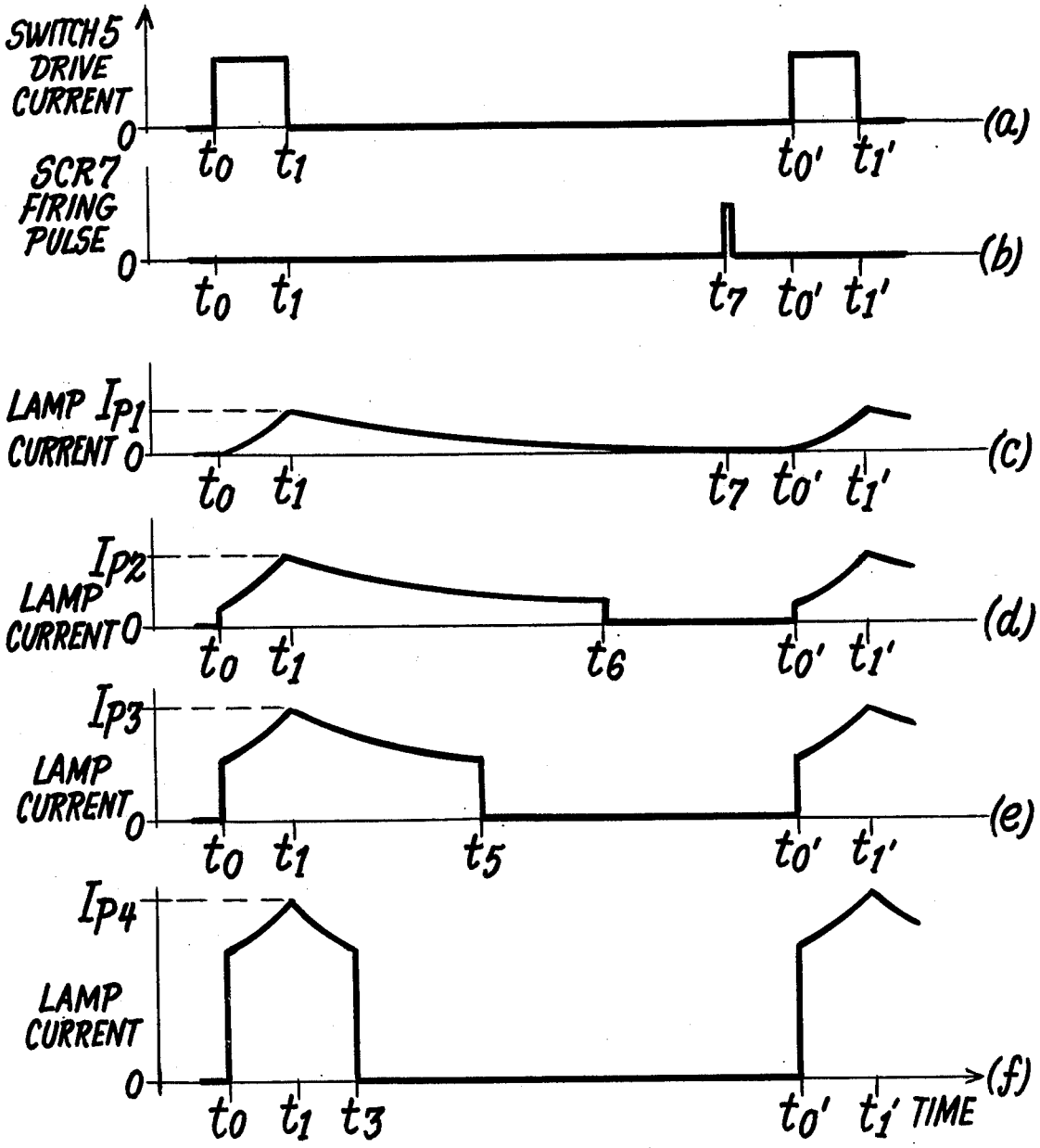
FIG. 4 shows a number of current waveforms relating to the operation of the FIG. 3 circuit.

Sensing circuit 10 is connected to variable control circuit 11 which, when energized by sensing circuit 10, actuates switch control circuit 9 in such manner that SCR switch 7 gradually fires sooner and sooner during its operating cycle with the effect of gradually increasing the peak value of lamp current, as illustrated in FIG. 4, and as more fully explained below. In this way, transistor switch 5 is protected from excessively high currents during the lamp starting interval.

Figure 7:
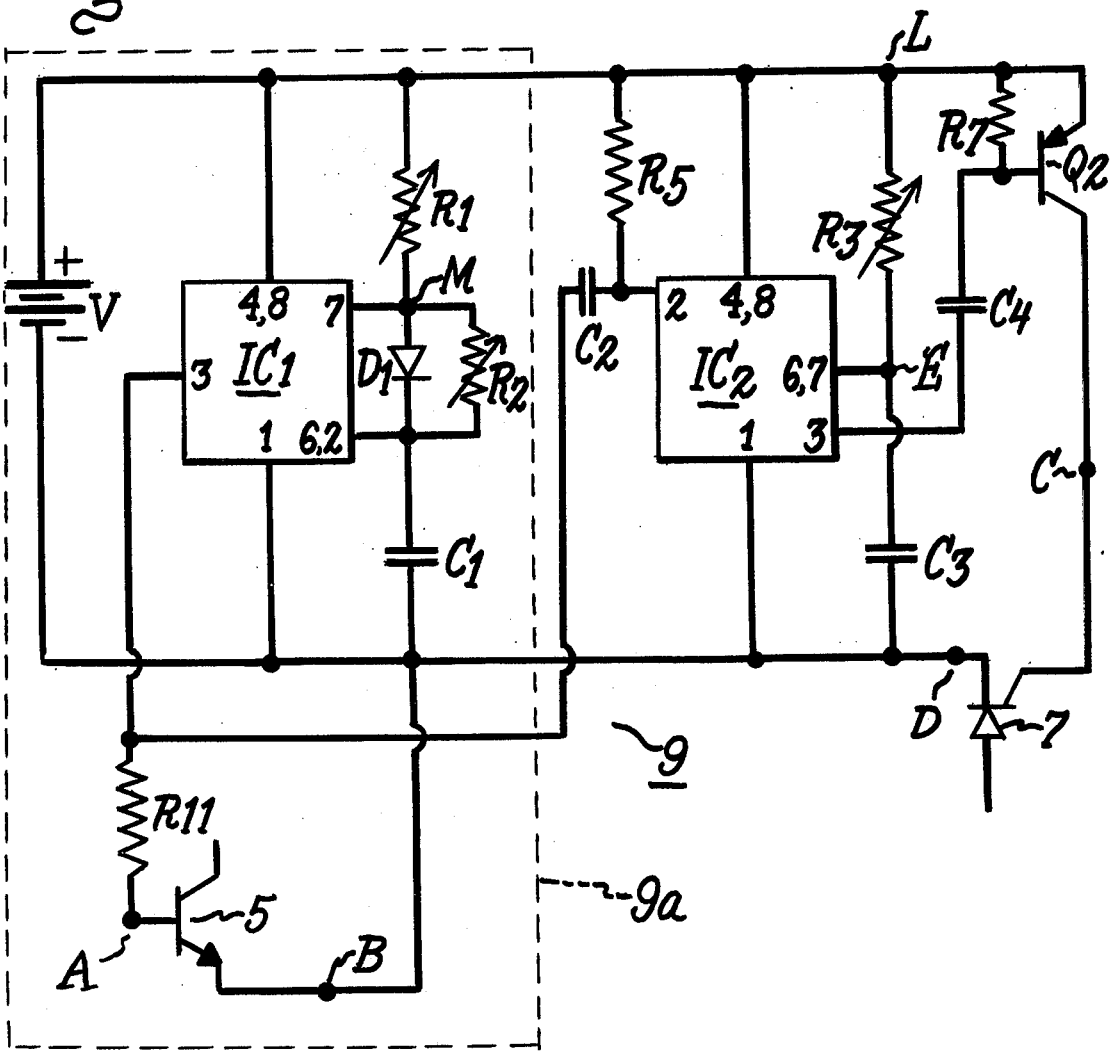
FIG. 7 shows the circuit details of the switch control circuits shown in FIGS. 1-3, 5 and 6.
Figure 8:
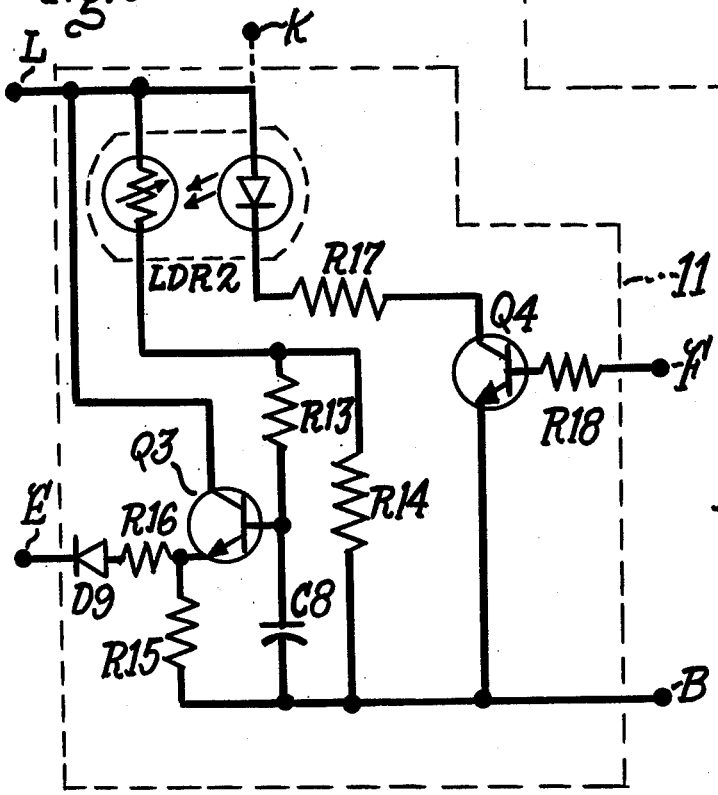
FIG. 8 shows the circuit details of the variable control circuit shown in FIG. 3 and 6.

As shown in FIG. 8, variable control circuit 11 comprises transistor switch Q4 connected at its base to sensing circuit 10 through resistor R18 and terminal F, its emitter connected to sensing circuit 10 at terminal B, and its collector connected via resistor R17 in series with the light emitting diode of LDR 2 (Light Dependent Resistor) which is connected at its anode via terminal L to the positive terminal of auxiliary voltage source V (see FIG. 7). The light dependent resistor of LDR 2 is connected at one side to terminal L and at its other side to the RC network comprising series-connected resistor R13 and capacitor C8. The base of transistor switch Q3 is connected to the junction of R13 and C8, its collector is connected to the positive terminal of the auxiliary voltage source V via terminal L, and its emitter is connected via resistor R16 in series with diode D9 to pin 6 of $IC_2$ (see FIG. 7) via terminal E, and connected via R15 to the other side of capacitor C8 and to the negative terminal of the auxiliary voltage source V via terminal B. Resistor R14 is connected across the RC network to discharge C8 when the circuit is not energized.

When variable control circuit 11 is not energized, the described pulsing circuit operates substantially as set forth in the aforementioned co-pending Knoble and Morais application. As there described, when the output voltage of $IC_1$ (pin 3) goes low, a negative pulse is applied through capacitor $C_2$ to the trigger input (pin 2) of $IC_2$. This causes the output of $IC_2$ to go high and pin 7 to turn off. Then capacitor $C_3$ begins charging from zero volts through resistor $R_3$ with a time constant $R_3C_3$. When the voltage on $C_3$ reaches 2/3 V, the output voltage goes low, and $C_3$ discharges through pins 7 and 1. The output then remains low until another trigger pulse is received from $IC_1$. The output pulse is then differentiated by capacitor $C_4$ and the negative transition of this output pulse is amplified and inverted by transistor $Q_2$. This pulse is applied to the gate of SCR 7 to turn the SCR on.

Accordingly, with particular reference now to FIG. 3, when there is no voltage across inductor L1 (when lamp 1 is out), no voltage build-up occurs across capacitor C8 of variable control circuit 11, and under these conditions transistor switch Q3 is off. At this time, SCR 7 is timed by control circuit 9 to fire at time $t_7$, as shown in FIG. 4(*b*). By such firing, as seen in FIG. 4(*c*), the peak of the lamp starting current is markedly reduced.

Once lamp 1 starts and voltage appears across inductor L1, sensing circuit 10 senses this voltage and triggers the operation of variable control circuit 11 (see FIG. 8) by turning on switch Q4, so that current begins to flow through the light emitting diode of the LDR 2 combination. As a result, the light dependent resistor of LDR 2 begins to decrease very quickly, e.g., to a value of a few hundred ohms. The voltage across capacitor C8, which is of large capacitance, begins to rise very slowly with a time constant which depends on the value of capacitor C8, resistors R13 and R14, and the final "on-state" value of the light dependent resistor. Transistor Q3 is connected as an emitter follower, so the voltage appearing at the output (cathode) of diode D9 (pin 6 of $IC_2$) reflects the slowly rising voltage of capacitor C8.

Diode D9 serves to isolate the variable control circuit when the lamp operating current reaches steady state, as described below.

With reference to the waveforms shown in FIG. 4, the waveform in (a) is characteristic of the operation of transistor switch 5 by control circuit 9 where $t_0$ is the time of turn-on of the switch and $t_1$ is the time of turn-off of the switch. The waveform in (b) illustrates the time of turn-on of SCR 7, with reference to the time of operation of transistor switch 5. The designation $t_7$ indicates the time of the pulse for firing SCR 7 by operation of control circuit 9. The waveform in (c) illustrates the lamp current at the beginning of the lamp starting interval, wherein the peak current is $I_{p1}$, the level of which is determined by the combined impedance of L1 and lamp 1 and the on time of switch 5, and, as shown, the current decays to a very low value by the time SCR switch 7 turns on. The gradual decay of current after time $t_1$ is due to operation of coasting diode 8 (see FIG. 3). When the SCR firing time is selected to occur near the end of the current decay, as shown in FIG. 4(*c*), the SCR will not remain on, due to insufficient current passing therethrough, hence there is no storage of energy in inductor L1.

As seen in FIG. 4(*d*), when SCR 7 is fired before complete decay of lamp current, as at time $t_6$, the SCR will remain on from $t_6$ to $t_0'$, when transistor switch 5 again turns on. The waveform in (*e*) depicts a later point in time at which the SCR is fired sooner than previously, resulting in more energy remaining in inductor L1 since the decay of current has not proceeded as far. By providing for the storage of more energy in inductor L1 in this way, the peak lamp current is increased gradually, until finally the steady state operating current of the lamp is reached, as limited by the combined impedance of inductor L1 and lamp 1. Thus, the gradual increase in peak current provided by the earlier firing in stages of the SCR in accordance with the invention corresponds generally to the gradual increase in the lamp impedance during the lamp starting and warm-up period.

While other means such as induction coil L1 as disclosed in the above-mentioned Patent of Knoble and Morais have been used or suggested for use to limit the peak starting current, this has not proved fully satisfactory, because with such an arrangement, the lamp current during the period before steady state operation is higher than the operating current, hence the components must be of higher rating to sustain these initial currents. By virtue of the present invention, the increase in lamp current during the starting and warm-up period is automatically controlled so that the peak current does not exceed the lamp operating current.

Figure 5:
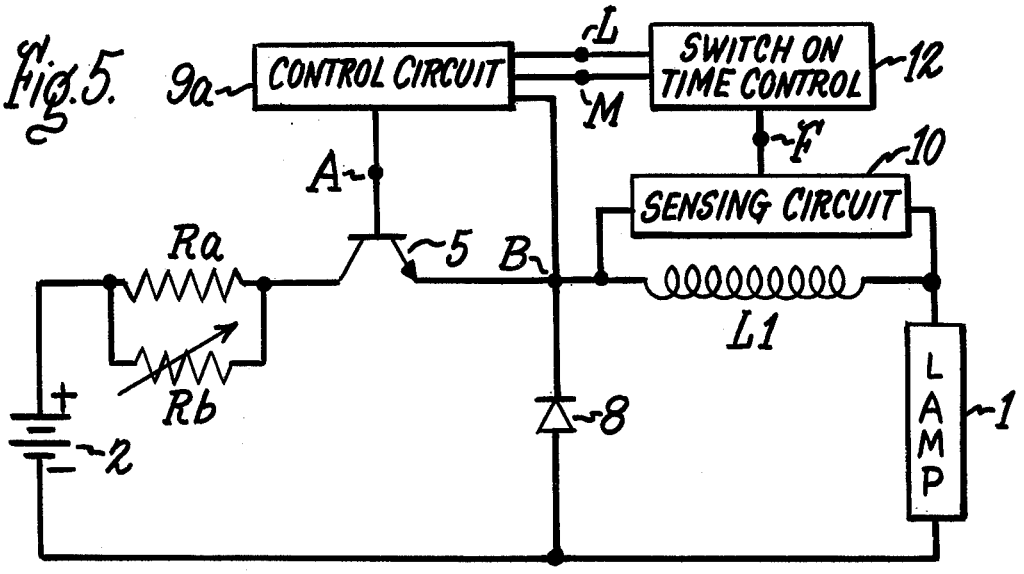
FIG. 5 shows another modification of the FIG. 1 circuit including a switch on-time control device.
Figure 10:
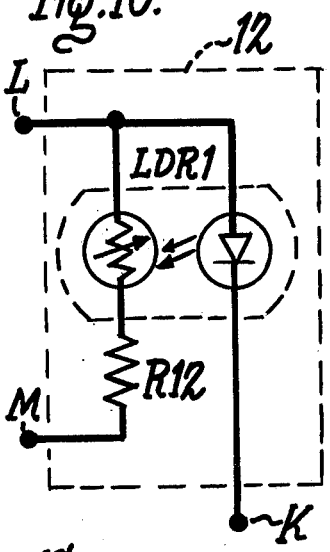
FIG. 10 shows the circuit details of the switch on-time control circuit shown in FIGS. 5 and 6.

FIG. 5 shows a modification of the FIG. 1 circuit wherein means are additionally provided for increasing the "on" time of transistor switch 5 during the lamp starting interval, in order to ensure proper starting of gaseous discharge lamp 1 by the pulsed operating circuit. For this purpose, sensing circuit 10 is connected across inductor L1 and switch on-time control circuit 12 is connected to sensing circuit 10 and switch control circuit 9*a* as shown. The on-time control circuit 12 as seen in FIG. 10 comprises the light dependent resistor-light emitting diode combination LDR 1 connected at one side to control circuit 9*a* via terminal L of the lead, with the other side of the light dependent resistor connected to control circuit 9*a* via series resistor R12 and terminal M. In this embodiment, switch Q4 with associated resistors R17 and R18 as shown in FIG. 8 would be connected to the other side of the light emitting diode of LDR 1 via terminal K. Control circuit 9*a* (see FIG. 7) controls the frequency and the "on" time of transistor switch 5, and, specifically, variable resistor R2 controls the frequency of the switch operation and variable resistor R1 controls its "on" time. The larger the value of R1, the longer the "on" time.

As disclosed in the aforementioned Knoble and Morais Patent the function of control circuit 9*a* is to produce a base drive current in transistor 5 for closing that switch and to remove the base drive current to open the switch, the base drive being produced between terminals A and B. Other details of the operation of control circuit 9*a* are set forth in the aforesaid Patent. For the purposes of operating switch 5 in accordance with the embodiment of the present invention shown in FIG. 5, variable resistor R1 in control circuit 9*a* is so adjusted that when the operating circuit is energized, and prior to starting of lamp 1, the on time of transistor switch 5 is prolonged for a suitable period substantially longer than the on time of the switch after the lamp has started. By virtue of the on-time control circuit 12, the on-time of switch 5 is automatically decreased to the normal on-time period after lamp 1 has started (ignited). The branch of the on-time control circuit comprising the light dependent resistor (LDR) and resistor R12 is connected across variable resistor R1 in control circuit 9*a*, as indicated by its connection to terminals L and M. Thus, the lower the resistance of LDR, the shorter the on-time of switch 5.

The operation of on-time control circuit 12 is as follows. When sensing circuit 10 detects a voltage across L1 at the beginning of the lamp starting interval, transistor Q4 turns on and current begins to flow through the light emitting diode of LDR 1 from the positive terminal of the auxiliary voltage source V shown in FIG. 7. The light emitted by the diode when current flows through it causes the resistance of the light dependent resistor (LDR) to decrease.

This LDR is chosen to have a very large "dark" or "off-state" resistance and low "on-state" resistance. Thus, the resistance of the LDR decreases quickly to a low value, causing the on-time of switch 5 to decrease to the desired normal period following lamp ignition.

The circuit of FIG. 5 thus provides for reduction of peak lamp starting current by virtue of the operation of parallel resistors R*a* and R*b* as described in connection with FIG. 1, and also provides for increased on-time of switch 5 for facilitating lamp starting, by virtue of the on-time switch control circuit 12, as just described.

Figure 6:
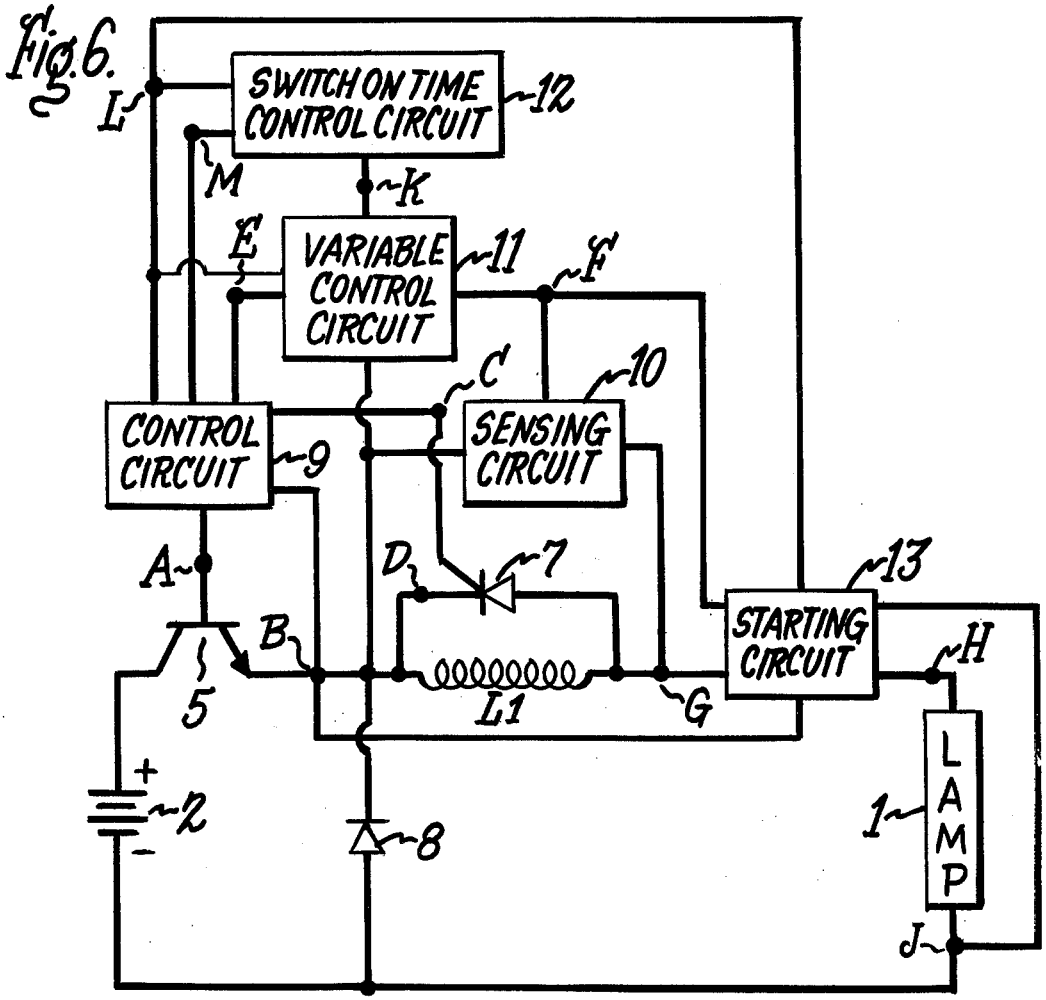
FIG. 6 is a circuit diagram of an embodiment similar to the FIG. 3 circuit and including a starting circuit for the lamp and a switch on-time control circuit.
Figure 11:
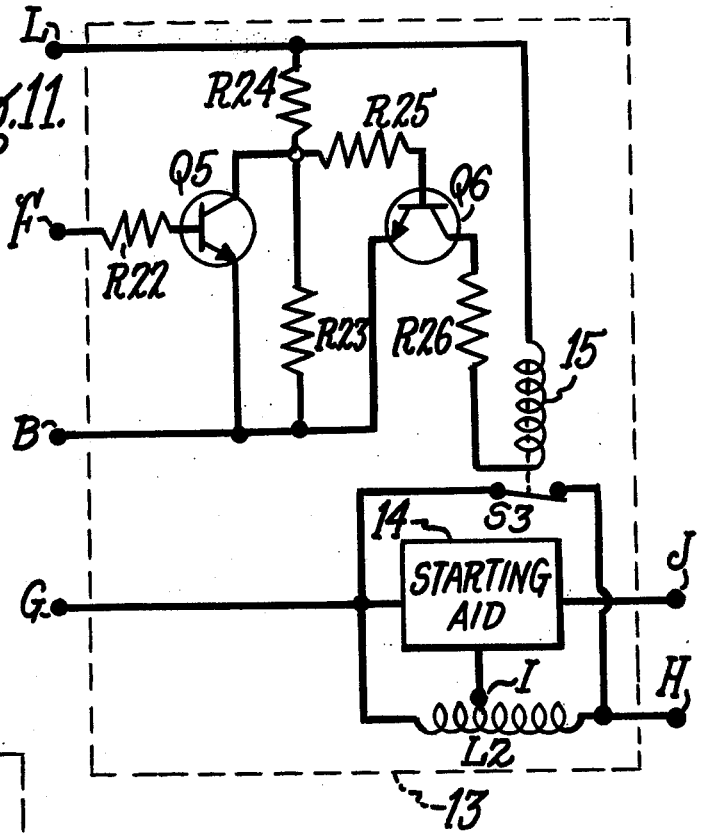
FIGS. 11 and 12 show the circuit details of the starting circuit shown in FIG. 6.
Figure 12:
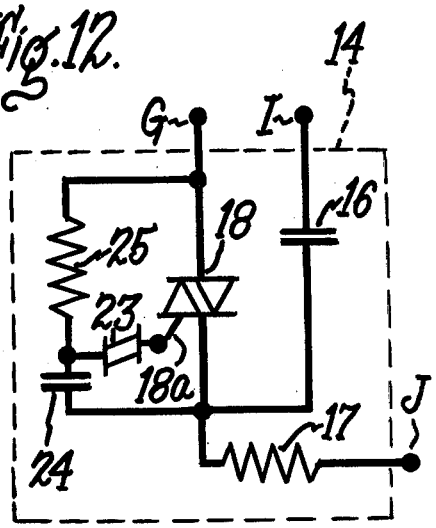

FIG. 6 shows an embodiment of the invention which includes both a variable control circuit as shown in FIG. 3 and a switch on-time control circuit as shown in FIG. 5, and further incorporates a lamp starting circuit useful for starting certain gaseous discharge lamps, such as high pressure sodium vapor lamps. Lamps of this type require relatively high voltage pulses in order to be ignited and thereafter operate on a lower voltage. Starting circuit 13, as shown in detail in FIG. 11, comprises induction coil L2 arranged in series between inductor L1 and lamp via terminals G and H, respectively. Connected to a tap I on induction coil L2 is starting aid 14 of known type, as depicted in FIG. 12. Such a starting aid is of the type disclosed in the patent to Nuckolls U.S. Pat. No. 3,917,976 issued Nov. 4, 1975, as well as in co-pending application of Morais Ser. No. 692,078 filed June 2, 1976, now U.S. Pat. No. 4,045,709 both assigned to the same assignee as the present invention. Those disclosures are accordingly incorporated herein by reference.

As seen in FIG. 12, this high voltage pulse generator circuit comprises capacitor 16 which is connected at one side to tap I on inductor L2 and at the other side to resistor 17, which is connected at its other side to terminal J. A voltage sensitive switch 18, such as a triac, is connected between terminal G at one side of inductor L2 and the junction of capacitor 16 and resistor 17. Gate electrode 18*a* of the triac is connected to a voltage sensitive triggering device 23 such as the silicon bilateral switch (SBS) shown. The firing of triac 18 is controlled by an RC timing circuit comprising capacitor 24 and resistor 25 connected in series across the triac, with SBS 23 connected to the junction thereof. In the operation of this circuit, capacitor 16 is initially charged by DC current flowing from the DC supply through switch 5, inductor L1 and a portion of inductor L2, and the circuit including capacitor 16 and resistor 17 back to the DC suply. Capacitor 24 is charged through switch 5, inductor L1 and resistor 25 until the voltage across it reaches the breakdown level of SBS 23, at which time traic 18 is triggered on. When this occurs, capacitor 16 discharges through the tapped turns of inductor L2 at its input end, inducing a high voltage, e.g. 3000 volts, in inductor L2, acting as an autotransformer. Pulses of this high voltage level are produced across lamp 1 by repeated charging and discharging of capacitors 16 and 24 in the described starting circuit until the lamp ignites. Upon starting of the lamp, the described high voltage ignition circuit ceases to operate as a result of the voltage clamping action of the ignited lamp load, and therefore the voltage build up across capacitor 24 does not reach the breakdown level of voltage sensitive switch 23.

It has been found that in some cases when current is allowed to flow through inductor L2 during operation of the lamp, substantial noise was produced in the inductor. To avoid this problem, a bypass circuit as shown in FIG. 11 is provided to bypass inductor L2 after starting of the lamp. This circuit comprises normally closed switch S3 connected as shown across inductor L2. Switch S3 is actuated by relay coil 15 connected at one side to terminal L and at the other side in series with resistor R26 which is connected to the collector of transistor switch Q6. The emitter of Q6 is connected to terminal B. The base of Q6 is connected to resistor R25 which is connected to the junction of resistor R24, the collector of transistor switch Q5, and resistor R23. The other side of R24 is connected to terminal L, the other side of R23 is connected to terminal B, the emitter of Q5 is also connected to terminal B, and the base of Q5 is connected via resistor R22 to terminal F.

So long as switch S3 is closed, the starting aid circuit 14 is inoperative since S3 bypasses inductor L2. When the main circuit is first energized, the auxiliary voltage supply of control circuit 9 (see FIG. 7) is also energized and this in turn energizes control circuit 9. A voltage signal with a certain "on" time and frequency is developed at pin 3 of $IC_1$. This signal turns on transistor switch 5 with the same frequency and "on" time (duty cycle). At the same time, since no current is yet flowing through inductor L2 (sensing circuit 10 still not energized), transistor Q5 is off, transistor Q6 turns on, energizing relay coil 15, which in turn opens switch S3. Once S3 is opened, starting aid circuit 14 will begin to function by drawing current every time transistor switch 5 is on. This current will also flow through inductor L1, but because it is very small, it is insufficient to activate sensing circuit 10, thus preventing inadvertent triggering of the various control circuits. When the pulses from starting aid circuit 14 cause the lamp to start, a much larger current (lamp current) begins to flow through L1. The voltage which develops across L1 is sensed by sensing circuit 10, causing transistor Q5 in starting circuit 13 to turn on, and as a result, current from energy supply V via terminal L will flow through R24 to the collector and emitter of Q5 to terminal B, thus bypassing Q6 and turning it off. Relay coil 15 is accordingly de-energized, closing switch S3 which bypasses inductor L2 and the starting aid circuit.

As will be seen in FIG. 6, switch on time control circuit 12 is connected to variable control circuit 11, these circuits in combination controlling the on time of switch 5 and the peak current through the latter switch at the starting and warm-up period of the lamp as disclosed in connection with the previously described embodiments. In such interconnection of control circuits 11 and 12 (see FIGS. 8 and 10), the anode of the light emitting diode in LDR 2 of control circuit 11 is connected via terminal K to the cathode of the corresponding diode of control circuit 12, and the connection of the LDR 2 diode to terminal L is removed. As will be understood, the branch comprising transistor switch Q4 and associated resistors as shown in FIG. 8 serves also to actuate control circuit 12 in such interconnection of control circuits 11 and 12.

The various control circuits shown in FIG. 6 otherwise operate substantially as described previously.

In those cases where noise due to current passing through inductor L2 is not a problem, the bypass circuit described above in connection with FIG. 11 may be dispensed with, using only starting aid circuit 14.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A lamp starting and operating circuit comprising, in combination, a direct current source, controlled switch means and inductance means connected in series across said power source, means for serially connecting a gaseous discharge lamp to said controlled switch means and said inductance means, means connected to said controlled switch means for limiting the peak current through said controlled switch means during the lamp starting interval, and control means coupled to said controlled switch means for repetitively and sequentially operating the same at predetermined intervals for applying DC pulses to the gaseous discharge lamp for starting and operation thereof.

2. A circuit as defined in claim 1, including unidirectional conducting means connected across said series connected inductance means and said lamp connecting means, and second controlled switch means connected to said control means and coupled to aid inductance means for stopping current flow to the gaseous discharge lamp and for storing magnetic energy in said inductance means while said second controlled switch means is on.

3. A circuit as defined in claim 2, said peak current limiting means comprising sensing circuit means for sensing the voltage across said inductance means, and second control means connected to said sensing circuit means, said second controlled switch means and said first mentioned control means for operating said second controlled switch means in response to the voltage across said inductance means, said second controlled switch means connected across said inductance means.

4. A circuit as defined in claim 3, including third control means comprising control circuit means for providing a longer on time of said first mentioned controlled switch means during the lamp starting interval than during the normal operation of the lamp, whereby the starting and warm-up of the lamp are facilitated.

5. A circuit as defined in claim 1, and auxiliary control means connected to said first mentioned control means and said inductance means for providing a longer on time of said controlled switch means during the lamp starting interval than during the normal operation of the lamp, whereby the starting of the lamp is facilitated.

6. A circuit as defined in claim 1, said peak current limiting means comprising resistance means connected in series with said controlled switch means.

7. A circuit as defined in claim 3, said second control means comprising first transistor means connected and responsive to said sensing means, and combined light producing and responsive means coupled to said first transistor switch means and said first mentioned control means for controlling the time of operation of said second controlled switch means for limiting and gradually increasing the peak lamp current until the end of the lamp starting interval.

8. A circuit as defined in claim 1, including means connected to said control means for controlling the on time of said controlled switch means for increasing the on time thereof for starting the lamp.

9. A circuit as defined in claim 8, said peak current limiting means comprising resistance means connected in series with said controlled switch means.

10. A circuit as defined in claim 7, including means connected to said second control means for controlling the on time of said first mentioned controlled switch means for increasing the on time thereof for starting the lamp.

11. A circuit as defined in claim 10, said on time controlling means comprising second combined light producing and responsive means coupled to said first transistor switch means, said first mentioned combined light producing and responsive means and said first mentioned control means.

12. A circuit as defined in claim 10, and starting circuit means connected to said lamp connecting means, said control means, said peak current limiting means and said on time controlling means for starting the lamp.

13. A circuit as defined in claim 12, said starting circuit means comprising an induction coil connected in series with said inductance means and said lamp connecting means, starting aid means connected to said induction coil and across said lamp connecting means, bypass circuit means comprising a controllable switch connected across said induction coil, and controlling circuit means connected to said controllable switch for opening the same during the lamp starting interval and for closing the same after the lamp starts, so as to bypass lamp operating current around said induction coil during normal operation of the lamp.

* * * * *